United States Patent [19]

Harvey et al.

[11] 4,177,227

[45] Dec. 4, 1979

[54] LOW SHEAR MIXING PROCESS FOR THE MANUFACTURE OF SOLID PROPELLANTS

[75] Inventors: Kenneth L. Harvey, Pleasant Grove; Howard D. Dixon, Salt Lake City, both of Utah

[73] Assignee: The United States of America as represented by the Secretary of the Air Force, Washington, D.C.

[21] Appl. No.: 612,435

[22] Filed: Sep. 10, 1975

[51] Int. Cl.[2] ..... C06B 45/10

[52] U.S. Cl. ..... 264/3 R; 149/19.1; 149/19.9; 149/19.92

[58] Field of Search ..... 149/7, 19.9, 19.92, 149/19.1; 264/3 R

[56] References Cited

U.S. PATENT DOCUMENTS

| | | | |
|---|---|---|---|
| 3,685,163 | 8/1972 | Olt | 149/19.92 X |
| 3,730,792 | 5/1973 | Frost et al. | 149/19.9 |
| 3,801,385 | 4/1974 | Mastrolia et al. | 149/19.9 |
| 3,834,957 | 9/1974 | McDevitt et al. | 264/3 R X |
| 3,870,578 | 3/1975 | Nichols | 264/3 R X |
| 3,892,610 | 7/1975 | Huzinec | 149/19.92 X |

*Primary Examiner*—Edward A. Miller

*Attorney, Agent, or Firm*—Joseph E. Rusz; William J. O'Brien

[57] ABSTRACT

A low shear mixing process for preparing high solids, high viscosity rocket propellants in which the propellant ingredients are blended with an inert diluent to reduce the high shear mixing environment generated by conventional mixing techniques. The diluent is then removed by sublimation from the mixture through a freeze drying process prior to curing and casting the mix according to conventional techniques.

2 Claims, 1 Drawing Figure

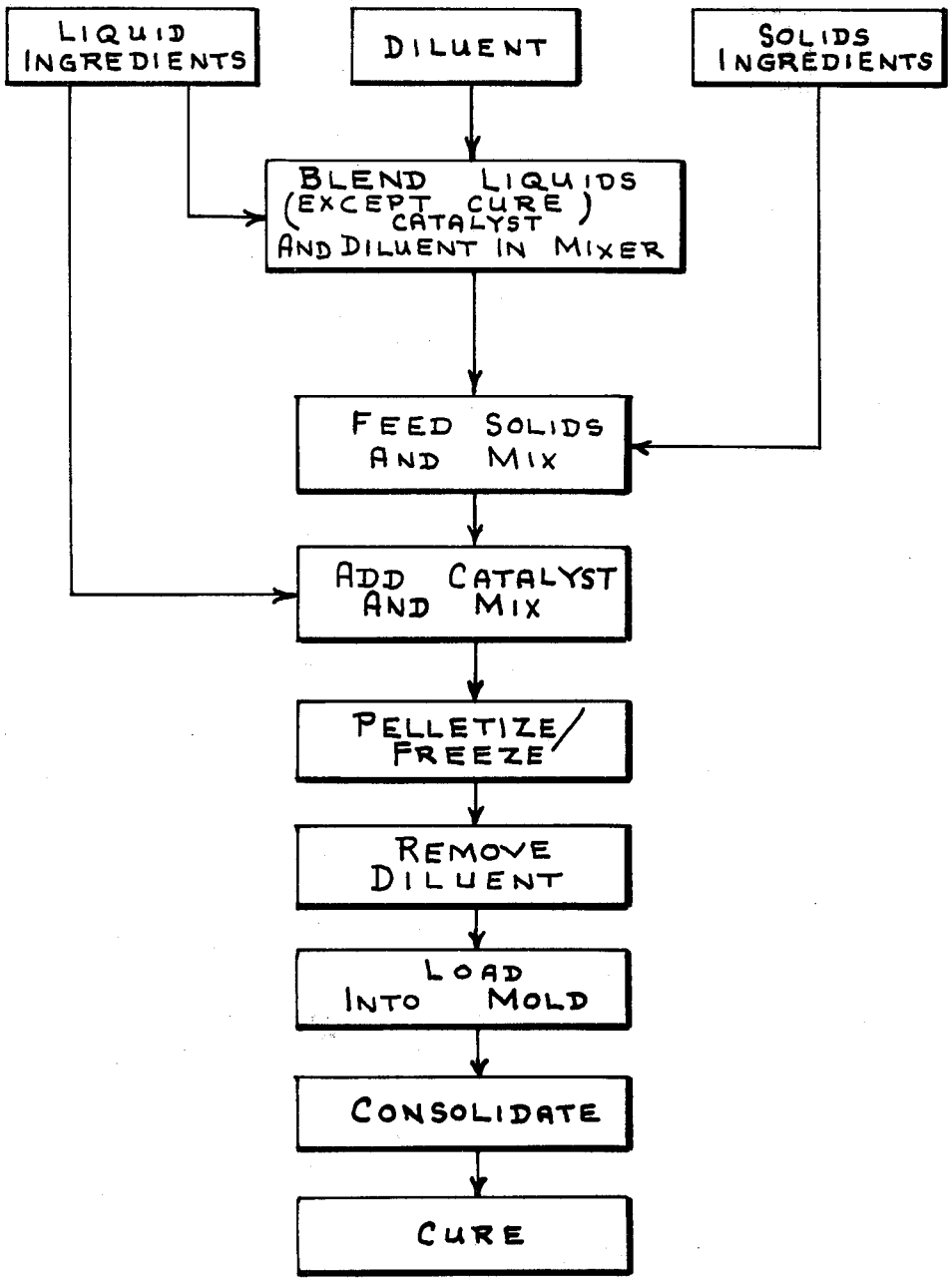
LIQUID INGREDIENTS
DILUENT
SOLIDS INGREDIENTS
BLEND LIQUIDS (EXCEPT CURE CATALYST) AND DILUENT IN MIXER
FEED SOLIDS AND MIX
ADD CATALYST AND MIX
PELLETIZE/ FREEZE
REMOVE DILUENT
LOAD INTO MOLD
CONSOLIDATE
CURE

LOW SHEAR MIXING PROCESS FOR THE MANUFACTURE OF SOLID PROPELLANTS

STATEMENT OF GOVERNMENT INTEREST

The invention described herein may be manufactured and used by or for the Government for governmental purposes without the payment of any royalty thereon.

BACKGROUND OF THE INVENTION

This invention relates to a process for preparing solid rocket propellants. More particularly, this invention relates to a low Shear Mixing process particularly adapted for mixing high solids, high viscosity, solid rocket propellants.

The present high interest in the operation of rockets and missiles has spawned a considerable research effort in the development of procedures and techniques for preparing and mixing solid rocket propellants. A number of problems have been encountered however, during the preparation of high solids, high viscosity propellant systems because of their sensitivity to friction and high temperature. Heretofore, the most common technique for the manufacture of solid rocket propellants involved the use of blade-type mechanical mixers. A variety of such mixers are used in the propellant manufacturing industry, including horizontal sigma blade, Ko-Kneaders, vertical single and double planetary, conical, and helical designs. These types of mixers are designed for heavy duty work, and the component tolerances are accurately controlled.

These mechanical high shear mixer systems, however, are limited as high solids, high viscosity propellant systems are developed. These propellant systems are, or may be characterized by high sensitivity relative to friction and temperature, short pot life, particle degradation, high transition potential, and high solids loading and viscosity. Relative to these new propellant systems, the mechanical mixers have inherent limitations. For example, the mixing of a high solids, high viscosity propellant involves considerable energy input resulting from the close tolerance, high shear mixing action. The Mixers impart high stresses to the driving and mixing components when processing these high viscosity formulations. This not only constitutes a hazardous condition but adversely effects and degrades propellant properties. Also, the elevated temperature mixing coupled with mix/cast cycle time frequently limits the processing of short pot life propellants. In addition, the high shear mixing action and close blade tolerances may be detrimental to ingredient particles or particle coating integrity which results in increased sensitivity problems.

Circumvention of the high shear mixing constraints and the pot life problem of propellant manufacture encountered with prior known mixing techniques have been overcome by the low shear processing concept of this invention. The concept includes operations from propellant mixing through casting and will be discussed in greater detail hereinafter. The principal process steps, however, are comprised of diluent mixing, propellant extrusion/freezing operations, diluent removal by freeze-drying and casting, all of which impart minimal shear force characteristics to a propellant mix.

SUMMARY OF THE INVENTION

In accordance with this invention, it has been found that high solids, high viscosity solid rocket propellants can be formulated by a low shear mixing process without incurring the detrimental effects on propellant ingredients that occur within a high shear mixing environment. The process of this invention has been found feasible for processing certain exotic, high solids loaded propellants which have been, or will be developed to meet increasingly stringent requirements of advanced propellant systems such as CTPB propellants with solids in excess of 90 percent HTPB propellants with solids of 92 percent or above, and composite propellants containing staples to attain sufficiently high burn rates for use in tactical weapon systems.

In brief, the mixing system of this invention includes the steps of diluent mixing in which the liquid and solid ingredients are blended with a liquid diluent. The mix is then frozen, granulated and the diluent separated by freeze drying. The granules are then cast and cured.

The process of the invention provides a means for manufacturing solid propellant materials that were not adaptable to processing by conventional techniques. It reduces the degradative effects imposed on rocket propellants by the high shear environment of the mechanical mixing procedures utilized heretofore.

Accordingly, the primary object of this invention is to provide a mixing process for preparing high solids, high viscosity solid rocket propellants.

Another object of this invention is to provide a process that reduces or eliminates the high shear environment associated with previously known mixing techniques.

Still another object of this invention is to provide a process that overcomes the detrimental effects on propellant ingredients that are produced by high shear mixing methods.

A further object of this invention is to provide a process for mixing propellant ingredients that does not limit the allowable solids loading in known propellant systems.

The above and still further objects and advantages of the present invention will become more readily apparent upon consideration of the following detailed description thereof when taken in conjunction with the accompanying drawing.

DESCRIPTION OF THE DRAWING

In the drawing:

The FIGURE discloses a flow sheet diagram of the low shear mixing process of this invention.

DESCRIPTION OF THE PREFERRED EMBODIMENT

Pursuant to the objects of this invention, the present method concerns itself with a low shear mixing process for preparing solid rocket propellants. Heretofore, it was found to be considerably difficult and almost impossible to mix certain exotic rocket propellants by conventional mixing techniques. The high shear forces generated during the mixing and casting stops of these prior art methods have been known to have a detrimental effect on propellant ingredients. The high shear phenomenon associated with conventional mixing methods limits the allowable solids loading in known propellant systems as well as the development of even more exotic propellants.

In an attempt to overcome these problems, it was found that a low shear process could be utilized effectively and efficiently to produce high solids, high viscosity solid rocket propellants. The low shear mixing process of the invention includes operations from propellant mixing through casting and includes the addition of a diluent to the propellant mix. The diluent is then removed by freeze-drying after the propellant has been extruded and granulated. The use of the diluent and its removal by a freeze-drying operation reduces the high shear forces developed when using prior art techniques.

Referring now to the drawing, the figure discloses a flow diagram of the low shear mixing process of this invention. In this process, the propellant is mixed in a blade mixer with diluent. The propellant is then frozen and granulated. The diluent is removed by freeze drying or by evaporation from the frozen propellant. The diluent-free solid propellant granules are then loaded into a mold and allowed to melt while under the influence of mechanical force. The propellant is cured under this mechanical force and consolidation of the propellant is further enhanced by the thermo-expansion occurring during cure. This process insures intimate contact of the binder with the solids. Gradation of particles in loading the mold is eliminated due to containment of the solids within the frozen propellant granule. The binder does not have to flow to encompass the solid particles.

The propellant mix is prepared in a blade type mixer of conventional design utilizing the diluent to lower the mix viscosity, minimize the sensitivity, provide a moisture barrier, and reduce the high shear energy input characteristic of high solids loaded propellants. When the mixing operation is completed, the propellant mix is immediately drawn off and pelletized. The pelletizing can be accomplished by first solidifying the propellant in a sheet and then dicing or shearing granules from the sheet. Alternatively and preferably, it can be pelletized by successive extrusion, shearing, and freezing operations.

The frozen propellant particles are then transferred to a conventional freeze-dry apparatus capable of maintaining the temperature of the propellant at a specific level below the freezing point of the propellant binder for diluent removal. The vacuum compartment provides for a controlled rate of heat addition to effect the removal of the diluent by sublimation.

The freeze-drying apparatus includes a maze-type, integral cooling chamber to provide for circulation of the cooling medium. To accomplish diluent removal from the propellant, the apparatus is operated remotely inside a vacuum chamber. The frozen pellets are transferred from an insulated container to the freeze-dry apparatus. A cooling medium (liquid nitrogen) is circulated through the cooling chamber to maintain the temperature of the propellant bed below the freezing point of the binder/diluent solution within specified limits of −110° to −118° C. to permit sublimation of the diluent from the propellant granules. A chromel-alumel thermocouple attached to the outside surface of the freeze plate at the same level as the propellant pellet bed feeds a signal to a temperature controller which controls the flow of coolant to the fixture.

Vibrators attached to the end of the fixture are actuated to vibrate the propellant pellets when poured onto the freeze plate and act as an aid during diluent removal by rotating the pellets to permit maximum exposed surface area, and prevent hangup during the mold loading operation. Following the diluent removal, the pellets are cast into a mold for subsequent consolidation and cure in accordance with standard consolidation and cure techniques.

The freeze-dried propellant granules are then loaded directly from the freeze-dry fixture into a jacketed mold under vacuum conditions. The propellant is consolidated as it thaws and is subsequently cured. A mechanical force applied to the propellant granule column causes propellant granules flow together under pressure and fill the interstitial volume.

In practice, the liquid ingredients are first added to the mixer, then the propellant solids, preslurried and well dispersed in the diluent carrier liquid, are charged to the mixer. The mixer is rotated for a short period of time during which the diluent wet solids are preferentially wetted by the propellant liquid. After this combining of the propellant ingredients, the diluent remains and mixing is continued.

The process provides a very gentle mixing action and affords an infinite mixture of all ingredients. The propellant formulation may contain a high percentage solids loading constant with acceptable mechanical properties of the propellant. The liquid propellant mix is then solidified by freezing and pelletized in preparation for diluent removal by freeze drying.

Ingredient addition, mixing and pelletizing are performed in a vacuum environment to prevent moisture contamination. The temperature of the blender and intermediate equipment which contacts the propellant ingredients is maintained at a level which will insure that ingredients remain in the solidified state throughout the freezing and pelletizing operations. Thawing and subsequent cure of the propellant takes place in the mold after diluent removal.

The process conditions are uniquely suited for processing moisture-sensitive ingredients. With the process equipment below the freezing or glass transition point of the liquid or binder ingredients, the moisture content of the atmosphere is measured in parts per million. Moisture introduced by leakage into the system condenses out in the solid phase to be removed during the subsequent thawing cycle while the system is under vacuum.

Since propellant mixing is accomplished at low rotational speeds, there is little action which would result in ingredient particle size degradation, coating damage, or initiation.

The process demonstrates the potential for handling composite propellants, including ingredients with uncertain thermal stability characteristics and heat-sensitive ingredients. Curing agents and plasticizers which have been known to react too fast for normal mixing operations can be used effectively.

In order to demonstrate the feasibility of the present invention, composite propellants, the detailed composition of which are set forth in Table I hereinafter, were selected for processing.

TABLE I

| Ingredient | Example 1 % By Wt. | Example 2 % By Wt. | Example 3 % By Wt. |
|---|---|---|---|
| Butarez II | 8.611 | 7.682 | 5.124 |
| ERLA 0510 | 0.0651 | 0.064 | 0.042 |
| DER 332 | 0.4234 | 0.414 | 0.276 |
| ZL 496 | 1.863 | 1.870 | 1.245[a] |
| DOA | 1.904 | 1.900 | 1.266 |
| Catalyst | 0.133 | 0.07 | 0.047 |
| $MoO_3$ | 1.00 | — | — |
| Oxamide | 6.00 | — | — |
| Aluminum H-30 | 10.0 | — | — |
| Aluminum H-10 | — | 5.0 | 5.2 |
| AP 400 | 57.0 | 31.0 | 31.0 |
| AP 200 | 10.0 | 32.0 | 32.0 |

TABLE I-continued

| Ingredient | Example 1 % By Wt. | Example 2 % By Wt. | Example 3 % By Wt. |
|---|---|---|---|
| AP 45 | 3.0 | — | — |
| AP 15 | — | 20.0 | 20.0 |
| UFAP 0.68 | — | — | 3.8 |

[a]Binder system of Example 3 is eight percent less than that of Example 2

In table I, AP is ammonium perchlorate and UFAP is ultrafine ammonium perchlorate. ERLA 0510 is a tri-epoxide crosslinker, DER 332 is a di-epoxide curative, ZL496 is non-functional polybutadiene, DOA is di-octyl adipate and $MoO_3$ is molybdenum trioxide.

The propellant of Example 1 was selected as processible by conventional techniques. Example 2 discloses a basic propellant to be modified for difficult-to-process by conventional techniques. Example 3 discloses a medification of Example 2 containing UFAP and was selected as a propellant difficult to process by conventional techniques. All of the propellants utilize a carboxy-terminated polybutadiene (CTPB) binder referred to as Butarez II.

The propellant selection was based on the lower viscosity range and slightly lower solids content of the example propellant (9–15) kilopoise and 87 percent solids) relative to the example 2 propellant without UFAP added (viscosity range of 1–20 kilopoise and 88 percent solids).

The example 3 formulation, modified to make the propellant more difficult to porcess included the addition of 3.8 percent UFAP and a reduced binder concentration to provide a 92 percent solids loading.

The addition of the UFAP and a reduction in the binder level to effectively increase the solids loading of the propellant to 92 percent was expected to increase the mix viscosity sufficiently to make diluent removal and subsequent casting by conventional methods extremely difficult if not impossible. The addition of UFAP was expected to enhance the propellant ballistic properties due to the increased surface area of the propellant oxidizer ingredient.

The role of the propellant formulations in these examples was not to attain optimum physical or ballistic properties but merely to demonstrate the feasibility of the low shear process of this invention in mixing high solids loaded propellants and to compare properties of propellants manufactured by the low shear and conventional process techniques.

The criteria considered in selecting a suitable diluent were freezing point, ease of removal (vapor pressure), compatibility with propellant ingredients, flammability, vapor explosive characteristics, and propellant ingredient solubility. Methylene chloride was selected as the diluent to use in the invention based on these criteria. A discussion of the diluent selection criteria follows.

The CTPB binder was shown to have a glass transition temperature of approximately −86° C. by differential scanning calorimetric tests. Better homogeneity of the frozen propellant was anticipated by using a diluent whose freezing temperature was approximately equal to the glass transition temperature of the propellant binder. Of the diluents investigated, five met the above criteria: Methylene chloride, heptane 2—2 dimethyl butane, 1—1 dichloroethane, and N-hexane with freezing points ranging from −90.6° C. to −98.2° C. Table II sets forth their characteristics.

TABLE II

| Diluents | Freezing Point (°C.) | Removal Characteristics Time (hr) | Temp (°C.) | Solvent Removed[c] (% by wt.) |
|---|---|---|---|---|
| Heptane | −90.6 | 4.5 | −196 | 37 |
| Methylene Chloride | −96.7 | 2.5 | −196 | 76 |
| 2-2 Dimethyl Butane | −98.2 | 3 | −196 | 58 |
| 1-1 Dichloroethane | −96.7 | 3 | −196 | 38 |
| N-Hexane | −94.3 | 3 | −196 | 33 |
| Petroleum Ether[d] | −73.0 | 3.0 | −196 | 80 |

[b]In reference to Table II, the term "binder" represents all ingredients in the propellant formulation except the solid fuel and oxidizers.
[c]Diluent removed by sublimation.

The CTPB binder was soluble in all of the candidate diluents investigated. Although no data was obtained concerning relative rates of solubility of the various ingredients in the different solvents, the binder appeared to be more readily soluble in the chlorinated solvents.

Table II shows the relative diluent removal characteristics of several of the diluents by the sublimation process. In these tests, the binder (containing about 67 percent glass beads) was mixed at approximately 20 percent diluent concentration and the mixture was spread into films of about 1/16 inch thickness. The samples were then frozen in liquid nitrogen and evacuated at 10 mm Hg. After the indicated time shown in Table II, the residual solvent was determined gravimetrically. Liquid nitrogen temperature was used because it was convenient. These data indicate that methylene chloride and petroleum either will sublime readily at the anticipated freeze drying temperature of about −110° C. About 76 percent of the methylene chloride was removed from the sheet in 2.5 hours compared to 80 percent removal of petroleum ether in 3 hours. The percent removal experienced by the other solvents was less than that for methylene chloride.

All diluents tested were compatible with the ingredients of the selected CTPB composite propellants. Of the two candidate diluents (methylene chloride and petroleum ether), which were shown to exhibit favorable removal characteristics by the freeze-dry process, only the methylene chloride was nonflammable.

Three solvents were investigated for explosive characteristics in the vapor phase because the solvent used as a diluent will initially evaporate in the vacuum chamber and subsequently will be sublimated in the near vacuum environment, thus introducing a possible hazardous condition. Heptane and petroleum ether were considered moderately explosive when vapor concentrations reached a range of 1.2 to 6.7 percent and 1.4 to 5.9 percent, respectively, when exposed to heat or flame. Based primarily on the diluent removal (sublimation) characteristics, flammability, and vapor explosive characteristics, methylene chloride was selected for use as the optimum diluent for the low shear process of this invention.

Sensitivity tests were conducted for the basic propellant formulations of Table I. The tests involved each formulation in the uncured slurry, uncured slurry with 30 percent diluent (methylene chloride), frozen uncured slurry, and cured states. The 30 percent diluent concentration in the uncured slurry tests was based on the diluent concentrations involved in the initial inert propellant tests. The concentration of diluent required to obtain optimum propellant extrusion characteristics for the Example 1 and Example 3 propellant formulations was considerably lower, e.g., 1 percent and 10 percent for Example 1 and Example 3 respectively.

Test results, shown in Table III, indicate the formulations to be relatively insensitive, especially at cryogenic temperature (approximately −196° C.). The sensitivity tests were conducted at ambient and approximately −196° C. These temperatures represent conditions anticipated during the propellant mixing and pelletizing operations, respectively. Tests representing the diluent removal operation temperature (approximately −110° C.) were not conducted because of the limited temperature control and application capability of the laboratory test equipment involved. However, the sensitivity values at −110° C. were assumed to be intermediate to the test temperatures shown in Table III.

Contrary to expected results, the impact and sliding friction sensitivity of uncured Example 1 and Example 2 propellants with 30 percent diluent added was increased slightly (11–13 cm impact and 49 pounds at 8 fps sliding friction) compared to the basic uncured slurry results (26 to 33 cm impact and 52–68 pounds at 8 fps sliding friction).

The electrostatic discharge (ESD) and autoignition (FJAI) characteristics of the slurry propellants with diluent added were equally insensitive to those of the basic formulation without diluent added.

The frozen propellant characteristics (−196° C.) were shown to be much less sensitive than the uncured slurry or the uncured slurry/diluent solution relative to impact and sliding friction. The only exception to this was the frozen Example 3 propellant characteristics. The impact sensitivity for the frozen slurry was only slightly higher, 21 vs 13 cm and 17 cm for the uncured slurry and uncured slurry with 30 percent diluent added.

Sliding friction for the frozen slurry was 96 pounds at 8 fps compared to 30 pounds at 8 fps and 118 pounds at 8 fps for the uncured slurry and uncured slurry with 30 percent diluent, respectively.

As noted in Table III, the Example 3 propellant is more sensitive than either of the two basic propellant formulations, Examples 1 and 2, presumably due to the presence of the UFAP and increased solids loading.

Based on the nominal magnitude of the uncured and frozen propellant impact and friction data and the low magnitude of the ESD and autoignition data exhibited by the Example 1 and Example 3 formulations, no problems were anticipated in manufacturing the selected propellants by the low shear mixing process.

TABLE III

| | Uncured Amb[1] | Uncured With 30% Diluent[1] | Frozen[a] | Cured |
|---|---|---|---|---|
| Ex. 1 propellant | | | | |
| Impact (cm) | 33 | 11 | >100 | 64 |
| Sliding Friction (lb@fps) | 68@8 | 49@8<br>112@6 | >1000@8 | 290@8 |
| ESD (joules) | >5 | >5 | >5 | >5 |
| FJAI (°C.) | >300 | >300 | — | >300 |
| Ex. 2 propellant | | | | |
| Impact (cm) | 26 | 13 | >100 | 41 |
| Sliding Friction (lb@fps) | 52@8 | 49@8<br>112@6 | 750@8 | 94@8 |
| ESD (joules) | >5 | >5 | >5 | >5 |
| FJAI (°C.) | >300 | >300 | — | >300 |
| Ex. 3 propellant[3] | | | | |
| Impact (cm) | 13 | 17 | 21 | 17 |
| Sliding Friction (lb@fps) | 30@8 | 118@8 | 96@8 | 28@8 |
| ESD (joules) | >5 | >5 | >5 | >5 |
| FJAI (°C.) | >300 | >300 | — | >300 |

[1]Tested at approximately 75° F.
[2]Tested at approximately −196° C.
[3]Includes 3.8 percent UFAP, 92 percent solids The propellant mixing was accomplished in a Baker Perkins mixer. Propellant viscosity was measured with a Model HBT Brookfield Viscometer. The mixed propellant was cast directly into an extrusion chamber. The extrusion and freezing operations were conducted in a glove box equipped with a nitrogen purge and an airlock to ensure a moisture-free environment during pelletizing operations.

Diluent removal was accomplished with a conventional freeze-dry apparatus using liquid nitrogen as the cooling medium and an electronic controller to maintain the temperature of the propellant bed at the desired temperature (−100° C. to −115° C.).

A mold loading apparatus of conventional design was used to thaw and initially cure the propellant grains. Water was pumped from an external heated reservoir to the heating jacket to maintain the temperature at the proper level (140° F. to 180° F.).

The freeze-dry, mold loading apparatus and associated pellet transfer equipment, were located in a 29 inch diameter vacuum chamber. All remote operations, including the extrusion/freezing operation and subsequent processing steps were performed in the vacuum chamber.

The composite propellant formulation of Example 1 was selected as the propellant to be processed by conventional techniques. The propellant, containing 87 percent solids, was mixed in nominal 500 gram batches. A total of 23 Example 1 propellant mixes, including three control mixes made in a vertical planetary mixer, were made. The initial mix (No. 3921-50) utilized a diluent concentration of 20 percent (25 percent of basic propellant weight added as diluent) based on inert propellant tests with the same CTPB binder system (Table IV). The apparent viscosity of the mix was observed to be extremely low for pelletizing by the extrusion process and was thus reduced to approximately 4.5 percent prior to the extruding operation. The diluant addition was ultimately reduced to 1 percent to improve the extrusion characteristics of the propellant, with an average mix viscosity slightly over ten kilopoise. The viscosity level of subsequent mixes ranged from 9 to 12 kilopoise at the ambient mix temperature which varied from 68° to 74° F.

The best extrusion size was found to be 3/16 inch diameter although the ⅛ inch diameter extrusion was found to be satisfactory. However, some agglomeration was experienced and approximately 5 percent hangup in the extrusion chamber occurred when using the ⅛ inch extrusion die (Mix No. 3921.86). When the extruded propellant was dip-frozen (in a liquid nitrogen reservoir) prior to the cutting operation, less agglomeration was experienced but propellant hangup was increased caused by cooling of the propellant near the base of the chamber. Increase in the diluent concentration to 3 to 5 percent with resultant decrease in propellant mix viscosity improved the propellant flow characteristics but impaired control of the pellet length because the propellant continued to flow between extrusion pressure strokes. The continued flow was apparently due to a combination of vapor pressure of the increased diluent and reduced mix viscosity.

Extrusion of 1/16 inch diameter pellets was unsatisfactory due to excessive hangup of propellant in the extrusion chamber and nonuniform characteristics.

Diluent removal was accomplished during a nominal 22 to 24 hour freeze-dry cycle followed by approximately 2 hours under vacuum during warmup to initial cure temperature. Diluent retention as low as <0.01 percent was measured. Diluent retention for a normal freeze-dry cycle was 0.03 to 0.09 percent after 24 hours at a freeze-dry temperature of −100° and −115° C., respectively, and approximately 0.01 percent after 46 hours at −100° C. as listed in Table V. Intermittent micro-sized air leaks in the vacuum system were experienced which resulted in retention of slightly more diluent than normal and with a slight to nominal amount of moisture contamination (0.16 to 2.1 percent) in the form of frost which collected on the freeze plate and propellant granules. Removel of the excess moisture was accomplished in the mold loading fixture during and after propellant thaw operations, under a vacuum, while the temperature was increased from the freeze-dry temperature to the initial cure temperature (nominally 140° F.) for a period of approximately 2 hours. As shown in Table IV, the diluent and moisture retention after a 22 hour freeze-dry cycle followed by the 2 hour elevated temperature-vacuum dry cycle was <0.01 percent diluent and 0.02 percent moisture.

TABLE IV

EXAMPLE 1 PROPELLANT MIXES

| Mix No. | Time (min) | Temp (°F.) | Percent Diluent | Ingredient Addition | Mix Viscosity (KP) | Orifice Size (in.) | Cutter | Dip Freeze | Agglomeration |
|---|---|---|---|---|---|---|---|---|---|
| 3921-50 | 60 | 76/100 | 4.5 | MB[2] | — | 1/8 | Wire | No | Yes |
| 3921-51 | 15 | 80 | 4 | MB | 3.07 | 1/8 | Wire | Yes | Some |
| 3921-52[3] | 30 | 130 | 0.6[4] | MB | 8.58 | | Control-Conventional Process | | |
| 3921-56 | 25 | 68 | 3 | MB | 2.75 | 1/8 | Wire | No | Some |
| 3921-57 | 25 | 68 | 1 | MB | 11.14 | 1/8 | Wire | Yes | Slight |
| 3921-58 | 30 | 70 | 1 | MB | 10.62 | 1/8 | Wire | Yes | None |
| 3921.66[4] | 25 | 135 | 0.6[4] | MB | — | | Control-Conventional Process | | |
| 3921-86 | 30 | 68 | 1 | MB | 12.8 | 1/8 | Wire | Yes | None |
| 3921-90 | 35 | 68 | 1 | MB | 12.00 | 3/16 | Wire | No | None |
| 3921-93 | 32 | 68 | 1 | MB | 10.56 | 1/16 | Wire | No | No extrusion |
| | | | | | | 1/8 | Wire | Yes | None |
| 3921-99 | 34 | 70 | 1 | MB | 9.76 | 3/16 | Wire | No | — |
| BC-166-44 | 32 | 69 | 1 | MB | 9.60 | 3/16 | Wire | No | None |
| BC-165-45 | 32 | 70 | 1 | MB | 9.76 | 3/16 | Wire | No | None |
| BC-166-46 | 35 | 70 | 1 | MG | 9.60 | 3/16 | Wire | No | None |
| BC-166-47 | 40 | 68 | 1 | MB | 9.92 | 3/16 | Wire | No | None |
| BC-166-48 | 35 | 68 | 1 | MB, incr ERLA | 9.12 | 3/16 | Wire | No | None |
| BC-166-58 | 35 | 73 | 1 | Epoxides added separately to mix | 12.00 | 3/16 | Wire | No | None |
| BC-166-60 | 35 | 72 | 1 | Epoxides added separately to mix | 11.04 | 3/16 | Wire | No | None |
| BC-166-63 | 35 | 74 | 1 | Epoxides added separately to mix | 10.72 | 3/16 | Wire | No | None |
| BC-166-66 | 20/15 | 140/71[6] | 1 | Epoxides added separately to mix | 8.64 | 3/16 | Wire | No | None |
| BC-166-67[1] | 35 | 140 | 0.6[4] | Epoxides added separately to mix | — | 3/16 | Wire | No | None |
| BC-166-70 | 25/15 | 140/68[6] | 1 | Epoxides added separately to mix | 6.08 | 3/16 | Wire | No | None |
| BC-166-71 | 25/20 | 140/70[6] | 1 | Epoxides added separately to mix | 8.00 | 3/16 | Wire | No | None |

| | Hang-Up (gm) | Temp (°F.) | Time (hr) | Vacuum (mmHg) | Diluent (%) | Water (%) | Vacuum (mmHg) | Temp (°F.) | Time (hr) | Diluent (%) | Moisture (%) | Comments |
|---|---|---|---|---|---|---|---|---|---|---|---|---|
| 3921-50 | —[5] | −115 | 19 | Poor | — | — | — | — | — | — | — | Lost vacuum, mold heating jacket ruptured |
| 3921-51 | — | −115 | 16 | 11 | 0.69 | — | — | — | — | — | — | Sealing of freeze dry vacuum bell difficult |
| | | | 20 | | 1.0 | | | | | | | |
| | | | 24 | | 0.93 | | | | | | | |
| 3921-52[3] | | — | — | — | — | — | — | — | — | — | — | |
| 3921-56 | — | −115 | 24 | 10 | 1.02 | — | — | — | — | — | — | Bell sealing problem |
| 3921-57 | — | −115 | 24 | 11 | — | — | — | — | — | — | — | Bell sealing problem |
| 3921-58 | 44 | −115 | 24 | 25-106 | — | — | — | — | — | — | — | Bell sealing problem |
| 3921-66[1] | — | — | — | — | — | — | — | — | — | — | — | |
| 3921-86 | 22 | −115 | 24 | 1 | 0.42 | — | — | — | — | — | — | |
| 3921-90 | 6 | −115 | 24 | 1 | — | — | — | — | — | — | — | |
| 3921-93 | | | | | | | | | | — | — | |
| | 74 | −115 | 24 | 1 | 0.09 | 0.16 | — | — | — | | | |
| 3921-99 | — | | 16 | | 0.04 | 0.02 | — | — | — | | | ⅔ mix used for freeze-dry test |
| | | | 20 | | 0.005 | 0.05 | | | | | | |
| | | | 24 | | 0.07 | 0.07 | | | | | | |
| BC-166-44 | — | −100 | 24 | 1 | 0.03 | 0.03 | | | | | | Blend of 3 mixes |
| BC-166-45 | — | | | | | | | | | — | — | |
| BC-166-46 | — | −100 | 24.5 | 1 | 0.03 | 0.03 | — | — | — | — | — | |
| BC-166-47 | — | −100 | 25 | 2 | — | — | — | — | — | — | — | |

TABLE IV-continued

| EXAMPLE 1 PROPELLANT MIXES | | | | | | | | | | | | |
|---|---|---|---|---|---|---|---|---|---|---|---|---|
| BC-166-48 | — | −100 | 24 | 1 | — | — | — | — | — | — | — | Increased ERLA to 0.5 grms to improve cure |
| BC-166-58 | — | −100 | 22 | 1 | — | — | 1 | 140 | 2 | <0.01 | 0.02 | Epoxide added separately to improve cure |
| | — | −100 | 46 | 4–8 | <0.01 | 0.21 | 4–8 | 140 | 2.0 | — | — | |
| | | −100 | 22 | 40 | — | — | 3–4 | 140 | 2 | — | — | |
| | | −100 | 22 | 3–4 | — | — | 3–4 | 140 | 2 | — | — | |
| | | −100 | 22 | 0.5 | — | — | 0.5 | 140 | 2 | — | — | |
| | | | 22 | 0.05 | — | — | 0.5 | 140 | 2 | — | — | |

[1]Control-Mixed by Conventional method
[2]Master batch of binder ingredients made for multiple mixes
[3]Control-Mixed by Conventional method-invalid results due to formulation error
[4]0.6% diluent used for addition of small quantities of liquid ingredients to mix. (Diluent removed during vacuum mixing)
[5]A dash indicates negligible
[6]Binder partial solids mixed at elevated temperature per revised mix procedure

TABLE V

| DILUENT REMOVAL, EXAMPLE 1 PROPELLANT | | | | | | | | |
|---|---|---|---|---|---|---|---|---|
| | | Freeze-Dry | | | Vacuum-Dry | | Diluent | Moisture |
| Mix No. | Percent Diluent | Temp (°C.) | Time (hr) | Vacuum (mm Hg) | Temp (°F.) | Time* (hr) | Retention (%) | Retention (%) |
| 3921-56 | 3 | −115 | 24 | 10 | — | — | 1.02 | N/A |
| 3921-93 | 1 | −115 | 24 | 1 | — | — | 0.09 | 0.16 |
| Blend** | 1 | −100 | 24 | 1 | — | — | 0.03 | 0.03 |
| BC-166-46 | 1 | −100 | 24.5 | 1 | — | — | 0.03 | 0.03 |
| BC-166-58 | 1 | −100 | 22 | 1 | 140 | 2 | <0.01 | 0.02 |

*Includes time for propellant thaw from freeze-dry temperature to elevated temperature
**Blend includes approximately equal increments of mixes 3921-99, BC-166-44, BC-166-45

Consolidation pressure applied during initial cure varied from 10 to 55 psi. Cure pressure varied between 0 and 38 psi. Test results were inconclusive relative to optimum consolidation and cure pressure levels due principally to cure problems experienced during the tests.

A total of five grains were processed by the low shear process with satisfactory results (BC-166-48, 58, 66, 70, and 71). These grains, including the last three which were utilized to obtain reproducibility data, utilized a consolidation pressure of 55 psi for 10 minutes at the initial cure temperature (140° F.) and then cured with no pressure applied during the extended cure cycle of 7 days at 140° F. X-ray inspection results indicated no voids in the grains except near the top or bottom of grains BC-166-58 and BC-166-71. Scattered high density inclusions were noted in grains BC-166-70 and BC-166-71 and also the control grain BC-166-67, as shown in Table VI. Initial mixes such as BC-166-51 were subjected to a freeze-dry cycle with less than optimum vacuum (approximately 11 mm Hg) resulting in excessive diluent retention (0.93 percent after 24 hours). Grain No. 3921-61, cured at 180° F., was shown to contain voids as shown in 5 inch long logbone samples shown in FIG. 27. Grain BC-166-70 (FIG. 28), freeze dried with approximately 1 mm Hg vacuum and cured at 140° F., resulted in a void-free grain. X-ray inspection did indicate the presence of scattered high density areas. Mixes with average mechanical properties were slightly lower than the control tensile strength of 53.9 psi, elongation of 63.6 percent, and modulus of 310 psi.

TABLE VI

| TEST RESULTS, EXAMPLE 1 PROPELLANT | | | | | | | | | | | | | |
|---|---|---|---|---|---|---|---|---|---|---|---|---|---|
| | Cure | | | | | | | Mechanical | | | | | |
| | | | | | | | | Tensile (psi) | | | Elongation(%) | | |
| Mix No. | Consol Press. (psi) | Min Time (Min) | Press. (psi) | Temp (°F.) | Days | Visual Observations | Sp G. | Max | Min | Avg | Max | Min | Avg |
| 3921-30 | | | 38 | 180 | 7 | Appears homogeneous. partial cure | | Test aborted -ruptured heating jacket | | | | | |
| 3921-51 | | | 38 | 180 | 6 | Brittle | 1.738 | 24.2 | 18.3 | 21.3 | 2.66 | 1.78 | 2.22 |
| 3921-52[1,2] | | | 0 | 140 | 7 | Good Cure | 1.740 | 60.3 | 58.4 | 57.8 | 50.1 | 44.4 | 48.3 |
| 3921-56 | | | 38 | 180 | 7 | Not Cured | 1.730 | | | | | | |
| 3921-57 | | | 38 | 140 | 14 | Not fully cured | 1.730 | 39.2 | 26.4 | 31.2 | 22.4 | 19.1 | 21.2 |
| 3921-58 | | | 38 | 140 | 19 | Not fully cured | 1.738 | 19.1 | 14.0 | 16.1 | 38.8 | 32.6 | 36.2 |
| 3921-66[1] | | | 0 | 140 | 7 | Good Cure | 1.720 | 63.1 | 61.4 | 62.3 | 68.9 | 60.9 | 65.3 |
| 3921-86 | | | 38 | 140 | 7 | Not fully cured | 1.750 | | | | | | |
| 3921-90 | | | 38 | 140 | 7 | Partial cure | 1.684 | 17.7 | 15.0 | 16.3 | 3.41 | 2.81 | 3.16 |
| 3921-93 | | | 38 | 140 | 7 | Partial cure | 1.737 | 17.4 | 10.6 | 14.5 | 6.22 | 4.44 | 5.28 |
| | | | 38 | 140 | 7 | Good Cure | 1.743 | 45.4 | 32.1 | 37.0 | 31.5 | 14.2 | 20.8 |
| BC-166-46 | | | 38 | 140 | 9 | Not cured | 1.741 | | | | | | |
| BC-166-67 | 38 | 120 | 20 | 140 | 7 | Mod cure | 1.742 | 21.4 | 14.0 | 17.0 | 12.6 | 9.9 | 10.9 |
| BC-166-48 | | | 10 | 140 | 7 | Good cure | 1.700 | 66.8 | 38.2 | 48.7 | 16.44 | 6.37 | 10.5 |
| BC-166-58 | 55 | 10 | 0 | 140 | 7 | Good cure | | 36.4 | 20.2 | 30.9 | 36.7 | 20.4 | 28.6 |
| BC-166-60 | 55 | 10 | 0 | 160 | 2 | Not cured | | | | | | | |

TABLE VI-continued

TEST RESULTS, EXAMPLE 1 PROPELLANT

| | | | | | | | | | | | | | |
|---|---|---|---|---|---|---|---|---|---|---|---|---|---|
| BC-166-63 | 55 | 10 | 0 | 180 | 2 | Not cured | | | | | | | |
| BC-166-66 | 55 | 10 | 0 | 140 | 7 | Good Cure | 1.728 | 50.0 | 41.1 | 41.1 | 41.1 | 64.5 | 48.1 |
| BC-166-67[1] | — | — | 0 | 140 | 7 | Good cure | 1.729 | 58.3 | 56.4 | 57.3 | 77.9 | 69.3 | 72.9 |
| BC-166-70 | 55 | 10 | 0 | 140 | 7 | Good cure | 1.739 | 60.0 | 47.5 | 53.9 | 68.1 | 58.1 | 63.6 |
| BC-166-71 | 55 | 10 | 0 | 140 | 7 | Good cure | 1.739 | 58.0 | 54.0 | 54.0 | 65.5 | 50.1 | 56.8 |

| | Mechanicals odulus (psi) | | | Durometer | | | Strand (in./sec) Pressure (psi) | | | |
|---|---|---|---|---|---|---|---|---|---|---|
| | Max | Min | Avg | Max | Min | Avg | 500 | 1000 | 1500 | X-ray |
| 3921-50 | | | | | | | | | | Homogeneous |
| 3921-51 | 1329 | 933 | 1074 | | | 80 | | | | Bottom half porous |
| 3921-52[1,2] | 803 | 509 | 651 | | | 68 | 0.146 | 0.247 | 0.355 | |
| 3921-56 | | | | | | | | | | |
| 3921-57 | 299 | 150 | 218 | | | 80 | 0.166 | 0.247 | 0.348 | |
| 3921-58 | 126.2 | 60.1 | 86.2 | | | 40 | 0.160 | 0.244 | 0.334 | Homogeneous, no visible voids |
| 3921-66[1] | 643 | 579 | 613 | | | 72 | 0.150 | 0.256 | 0.346 | 1 void top surface |
| 3921-86 | | | | | | 50 | | 0.242 | | Homogeneous, no visible voids |
| 3921-90 | 755 | 714 | 740 | 80 | 74 | 77 | (0.236 | 0.332)[3] | — | Same as above |
| 3921-93 | 336 | 298 | 318 | 50 | 42 | 46 | | | | Same as above |
| | 427 | 309 | 376 | | | 67 | 0.172 | 0.293 | 0.393 | Same as above |
| BC-166-46 | | | | 50 | 40 | 45 | | | | Same as above |
| BC-166-47 | 242 | 180 | 210 | 52 | 42 | 47 | 0.186 | 0.294 | 0.410 | Heavy porosity throughout |
| BC-166-48 | 1123 | 742 | 984 | 70 | 40 | 55 | 0.156 | 0.240 | 0.367 | Medium to heavy porosity throughout |
| BC-166-58 | 389 | 130 | 230 | 52 | 42 | 47 | | | | None, slight consol. void @ bottom |
| BC-166-60 | | | | | | | | | | |
| BC-166-63 | | | | | | | | | | |
| BC-166-66 | 305 | 281 | 291 | 70 | 60 | 65 | 0.170 | 0.238 | 0.352 | Consol, voids bottom grain |
| BC-166-67[1] | 436 | 387 | 416 | 78 | 74 | 76 | 0.152 | 0.203 | 0.280 | Scattered high density inclusions |
| BC-166-70 | 383 | 252 | 310 | 72 | 64 | 68 | 0.164 | 0.236 | 0.330 | Same as above |
| BC-166-71 | 358 | 295 | 326 | 74 | 68 | 71 | 0.169 | 0.248 | 0.356 | Voids top ⅔ of grain |

[1]Control - mixed by conventional method
[2]Results of this mix not valid to formulation error
[3]Questionable strand results

TABLE VII

EXAMPLE 3 PROPELLANT MIXES

| | Mixing Conditions | | | | | Extrusion @ 40 psi | | | | |
|---|---|---|---|---|---|---|---|---|---|---|
| Mix No. | Time (min.) | Temp (°F.) | Percent Diluent | Ingredient Addition | Mix Viscosity (KP) | Orifice Size (in.) | Cutter | Dip Freeze | Agglom-eration | (gm) |
| BC-166-49 | 35 | 68 | 8 | MB[1] Incr ERLA | 1.60 | 3/16 | Wire | Yes | Some | None |
| BC-166-50[2] | | 140 | Mix aborted - too viscous to mix | | | | | | | |
| BC-166-51 | 35 | 72 | | Eposide added separately | 16.00 | 3/16 | Wire | Yes | None | None |
| BC-166-52 | 18 | 73 | 8 | " | 14.40 | 3/16 | Wire | No | None | None |
| BC-166-53 | 35 | 72 | 9 | " | ~10.0 | 1/16 | Wire | No | Irregular | 400 |
| | | | | | | 1/8 | Wire | No | Irregular | 160 |
| | | | | | | 3/16 | Wire | No | | 50 |
| BC-166-54 | 35 | 72 | 10 | " | 4.48 | 1/8 | Wire | No | None | 44 |
| BC-166-55 | 35 | 74 | 10 | " | 4.74 | 3/16 | Wire | No | None | None |
| BC-166-56 | 35 | 74 | 10 | " | 4.48 | 3/16 | Wire | No | None | None |
| BC-166-57 | 35 | 73 | 10 | " | 5.25 | 3/16 | Wire | No | None | None |
| BC-166-59 | 35 | 73 | 10 | " | 6.02 | 3/16 | Wire | No | None | None |
| BC-166-61 | 35 | 73 | 10 | " | 6.02 | e/16 | Wire | No | None | None |
| BC-166-62 | 35 | 72 | 10 | " | 5.16 | 3/16 | Wire | No | None | None |
| BC-166-64 | 35 | 72 | 10 | " | 3/84 | 3/16 | Wire | No | None | None |
| BC-166-65 | 35 | 73 | 10 | " | 3.46 | 3/16 | Wire | No | None | None |
| BC-166-68 | 35 | 70 | 10 | " | 3.84 | 3/16 | Wire | No | None | None |
| BC-166-69 | 35 | 68 | 10 | " | 4.61 | 3/16 | Wire | No | None | None |
| BC-166-72 | 15/21[3] | 140/70 | 10 | " | 1.28* | 3/16 | Wire | No | 30%* | None |

| Mix No. | Temp (°C.) | Time (hr) | Vacuum (mm Hg) | Diluent (%) | Water (%) | Vacuum (mm Hg) | Temp (°F.) | Time (hr) | Diluent (%) | Moisture (%) | Comments |
|---|---|---|---|---|---|---|---|---|---|---|---|
| BC-166-49 | −100 | 24 | 1 | 0.06 | 0.06 | — | — | — | — | — | Questionable viscosity data Increased ERLA to 0.315 gm |
| BC-166-50[2] | −100 | | | | | | | | | | |
| BC-166-51 | −100 | 24 | 1 | 0.46* | 0.05 | — | | | | | |

TABLE VII-continued

EXAMPLE 3 PROPELLANT MIXES

| | | | | | | | | | | | |
|---|---|---|---|---|---|---|---|---|---|---|---|
| BC-166-52 | −100 | 26 | 1 | 0.01 | 0.05 | | | | | | |
| BC-166-53 | — | — | — | — | — | — | | | | | |
| | — | — | — | — | — | — | | | | | |
| | −100 | 22 | 1 | — | — | 1 | 140 | 2 | <0.01 | 0.02 | |
| BC-166-54 | −100 | 22 | 1 | — | — | 1 | 140 | 2 | 0.03 | 0.02 | |
| BC-166-55 | −100 | 22 | 1 | — | — | 1 | 140 | 2 | — | — | |
| BC-166-56 | −100 | 22 | 1 | — | — | 1 | 140 | 2 | <0.01 | 0.21 | |
| BC-166-57 | −100 | 22 | 1 | — | — | 1 | 50–120* | 2 | <0.01 | 0.02 | *Malfunction of heat reservoir |
| BC-166-59 | −100 | 22 | 1 | — | — | 1 | 140 | 2 | <0.01 | 0.02 | |
| BC-166-61 | −100 | 22 | 7–12 | $LN_2$ | Failure | 2 | 140 | 2 | — | — | |
| BC-166-62 | −100 | 22 | 3 | — | — | 3 | 50–125* | | — | — | *Malfunction of heat reservoir |
| BC-166-64 | −100 | 22 | 3 | — | — | 3 | 140 | 2 | — | — | |
| BC-166-65 | −100 | 44 | 4 | 0.85 | 0.11 | 4 | 140 | 2 | — | — | |
| BC-166-68 | −100 | 22 | 2.5 | — | — | 2.5 | 140 | 2 | — | — | |
| BC-166-69 | −100 | 22 | 0.5 | — | — | 0.5 | 140 | 2 | — | — | |
| BC-166-72 | −100 | 22 | 0.5 | — | — | 0.5 | 140 | 2 | — | — | |

*Viscosity reading taken prior to temperature stabilization
**Due to excess temperature during extrusion
[1]Master batch of binder ingredients made for multiple mixes
[2]Control - mixed by conventional process
[3]Revised mix procedure used Propellant hardness values, as measured with a Pandux durometer tester, show an approximate linear relationship with tensile strength and inversely with the elongation and provide an indication of extent of cure for grains that attained only partial cure. Some grains attaining partial cure, such as 3921-57 and 3921-90, indicate a high durometer reading in contrast to partially cured grain BC-166-46 which had a durometer reading of 45. The grains with high durometer readings were observed to exhibit other partial cure characteristics such as surface stickiness and nonuniform hardness properties, e.g., soft core.

The primary problem involved in the manufacture of KKA-102 propellant was incomplete cure. Assessment of the problem indicated a possible loss or nonreactivity of the epoxide crosslinkers. Tests were conducted to determine if the epoxides were being lost through evaporation during the freeze-dry cycle or the reactivity of the crosslinkers were affected during the thermal cycle. Test results indicated no loss of epoxides during the freeze-dry cycle, and no significant change in reactivity characteristics occurred due to the thermal cycle. Additional tests indicated that incomplete diffusion of one or more liquid binder ingredients, comprising an infinitesmal portion of the total mix weight, resulted from the normal room temperature (approximately 68° to 72° F.) mix cycle. The example 1 propellant mixing procedure was changed to include premixing of all liquid ingredients with a fraction of the propellant solids at an elevated temperature (140° F.). The temperature was then immediately reduced to room temperature, the balance of the solids and diluent were added, and mixing continued in accordance with the standard procedure.

All grains manufactured utilizing the modified mixing procedure were completely cured. Physical characteristics were approximately equivalent to, and burn rates slightly higher than, the control as indicated in Table VI.

The example 3 propellant containing 3.8 percent UFAP (0.6μ) and 92 percent solids loading was selected as the process difficult or impossible to process by conventional techniques.

Attempts to mix example 3 propellant by the same conventional process used to mix example 1 propellant resulted in failure due to the extreme viscosity of the propellant.

Seventeen mixes were made by the low shear process. The optimum propellant diluent concentration was 9.1 percent (10 percent of basic propellant weight added as diluent). Average viscosity of the example 3 propellant mixes was 4.47 kilopoise, varying from 3.46 to 6.02 kilopoise for propellant mixes containing 10 percent diluent as shown in Table VII. As the diluent was decreased to 7 percent of propellant weight, the mix viscosity was shown to increase to 16 kilopoise. The optimum diluent concentration was determined as a result of tradeoff studies between casting viscosity (casting of diluent mix into extrusion chamber) and extrusion viscosity. Diluent addition was limited to 10 percent to ensure a practical casting efficiency and yet result in satisfactory extrusion of the propellant. The extrusion equipment was capabable of extruding propellant of considerably higher viscosity levels. This indicates that a higher percentage of UFAP could have been used relative to the extrusion operation, provided that casting of the mix into the extrusion chamber could be accomplished.

The 3/16 inch diameter extrusion die was found to be most satisfactory for processing the example 3 propellant. Approximately 10 percent of a normal 425 to 475 gram mix was extruded using the 1/16 inch diameter die and 60 percent of the mix when using the 1/8 inch diameter die. Virtually all propellant was extruded for all mixes utilizing the 3/16 inch diameter die (Table VII).

Dip freezing of the propellant during extrusion/pellet shearing operations was found to have a negligible effect on pellet formation providing the mix viscosity was held at an acceptable level (approximately 3.5 kilopoise or above). Higher viscosity mixes were shown to be more amenable to the extrusion process than lower viscosity mixes. Propellant with a viscosity of 16 kilopoise was extruded without hangup of propellant in the extrusion chamber. (See mix BC-166-51, Table VII)

Diluent removel characteristics for the example 3 propellant were similar to those of the example 1 propellant. Removal of diluent to an acceptable level was shown to be possible in 24 to 26 hours. Diluent retention to levels as low as 0.01 percent diluent and 0.05 percent moisture was attained in 26 hours at −100° C. (mix BC-166-52, Table VII). When the propellant was freeze-dried for a period of approximately 22 hours and was then allowed to vacuum dry during thaw and warmup to initial cure temperature (140° F.), diluent and moisture retention was shown to be as low as 0.01 percent and 0.02 percent, respectively. (See mix BC-166-54, -56, -57, and -59, Table VI. Due to intermittent variation in vacuum level caused by more leaks in the vacuum system or freeze-dry fixture, all tests except those conducted specifically as diluent removal tests included the vacuum dry cycle to ensure the removal of excess moisture deposited on the pellets in the form of frost from the propellant.

Diluent mixing of the propellant formulations was accomplished at relatively low viscosity levels, e.g. approximately 5 kilopoise for example 3 (92 percent solids loading and containing 3.8 percent UFAP) and up to approximately 12 kilopoise for example 1 (87 percent solids loading). No high viscosity mixing was involved because the propellant/diluent mixture was cast directly into the extrusion chamber. The diluent remained in the propellant mix through all slurry handling operations and was then later removed from the frozen propellant granules by a freeze-dry process. Propellant consolidation of the example 1 propellant did not appear to be a problem. However, consolidation of the 92 percent solids, example 3 propellant by the application of force to the top surface of the grain was difficult. The difficulty was attributed to diluent properties of the propellant and the geometric configuration of the mold. Though successful consolidation was accomplished through moderate consolidation pressure (approximately 55–110 psi), it is suspected that inclusion of mold vibration operation during the consolidation operation would help to ensure void-free propellant grains. Utilization of a mold with improved geometric configuration would be expected to eliminate the difficulty experienced with propellent consolidation. Smaller propellant pellet sizes would also be expected to improve the consolidation characteristics of the propellant due to the smaller void size and resultant decrease in propellant deformation required to fill the voids. The test results of the example 3 propellant did not confirm this, however, due to incomplete grain inspection results of grain BC-166-54 made with ⅛ inch diameter pellets.

There were no observable trends linking consolidation/cure pressure to tensile strength, elongation, or modules as were noted in test results. Table VIII Durometer readings for the cured grains were relatively high with an average value of 90.

Propellant grains were successfully cured at temperatures of 140°, 160°, and 180° F. Elevated cure temperature was shown to have a marked effect on mechanical properties of the propellant. Grain BC-166-56, cured at 180° F., was characterized by high tensile strength (166 psi), low elongation (2.4 percent), and high modules (12,142 psi). Grain BC-166-59, cured at 160° F., exhibited qualities similar to grains cured at 140° F. except for lower elongation (2.5 percent versus an average elongation of 5.3 percent for grains cured at 140°). (See Table VIII).

Table VIII sets forth test results for a number of mixes for the propellant formulation of example 3.

TABLE VIII

TEST RESULTS, EXAMPLE 3 PROPELLANT

| | Cure | | | | | | | Mechanical | | | | | |
|---|---|---|---|---|---|---|---|---|---|---|---|---|---|
| | | | | | | | | Tensile (psi) | | | Elongation (%) | | |
| Mix No. | Consol Press. (psi) | Min Time (min) | Press. (psi) | Temp (°F.) | Days | Observations | Visual Sp g. | Max | Min. | Avg | Max | Min | Avg |
| BC-166-49 | | | 38 | 140 | 7 | Strong, brittle | 1.791 | 71.0 | 64.0 | 68.3 | 5.04 | 4.00 | 4.64 |
| BC-166-50 | Control, too viscous to mix, mix aborted | | | | | | | | | | | | |
| BC-166-51 | 40 | 50 | 20 | 140 | 7 | Good cure consol voids 75% | 1.654 | | | | | | |
| BC-166-52 | 60 | 5 | 10 | 140 | 7 | Good cure | | 123 | 118 | 121 | 6.7 | 5.3 | 6.0 |
| BC-166-53 | 55 | 10 | 0 | 140 | 7 | Good grain | 1.793 | 138 | 127 | 131 | 10.7 | 6.7 | 8.2 |
| BC-166-54 | 55 | 10 | 20 | 140 | 7 | Good cure | 1.802 | 152 | 151 | 152 | 7.7 | 7.3 | 7.5 |
| BC-166-55 | 38 | 10 | 20 | 140 | 7 | Not fully | 1.798 | 151 | 81.1 | 126 | 6.7 | 1.9 | 4.8 |
| BC-166-56 | 55 | 10 | 20 | 180 | 6 | Good cure | 1.808 | 173 | 158 | 106 | 3.9 | 1.5 | 2.4 |
| BC-166-57 | 55 | 10 | 0 | 140 | 7 | Good cure | 1.808 | 159 | 148 | 153 | 7.1 | 4.4 | 5.7 |
| BC-166-59 | 55 | 10 | 20 | 160 | 3 | Poor consolidation | 1.813 | 139 | 111 | 126 | 2.8 | 1.9 | 2.5 |
| BC-166-61 | 38/55 | 10/20 | 38 | 140 | 7 | Not consolidated | | | | | | | |
| BC-166-62 | 70 [1] | 10 | 38 | 180 | 2 | Not consolidated | | | | | | | |
| BC-166-64 | 110 | 10 | 38 | 140 | 7 | Good cure | 1.820 | 122 | 105 | 115 | 4.59 | 2.81 | 3.45 |
| BC-166-65 | 110 | 10 | 0 | 140 | 7 | Good cure | 1.820 | 138 | 98.5 | 116.5 | 4.1 | 2.8 | 3.6 |
| BC-166-68 | 150 | 10 | 38 | 140 | 7 | Brittle | | | | | | | |
| BC-166-69 | 150 | 10 | 38 | 140 | 7 | Good cure | 1.816 | 158 | 138 | 145 | 4.9 | 2.7 | 3.5 |
| BC-166-72 | 150 | 10 | 38 | 140 | 7 | Poor consolidation | No samples submitted | | | | | | |

| | Mechanical | | | | | | Strand (in./sec) | | | |
|---|---|---|---|---|---|---|---|---|---|---|
| | Modulus (psi) | | | Durometer | | | Pressure (psi) | | | |
| Mix No. | Max | Min | Avg | Max | Min | Avg | 500 | 1000 | 1500 | X-Ray Results |
| BC-166-49 | 3150 | 2610 | 2930 | | | | | | | Heavy porosity throughout |
| BC-166-50 | | | | | | | | | | |
| BC-166-51 | | | | 87 | 80 | 83.5 | 0.596 | 0.878 | 1.197 | Consol voids 75% grain |
| BC-166-52 | 5250 | 4358 | 4715 | | | 88 | | | | Consol voids |

TABLE VIII-continued

TEST RESULTS, EXAMPLE 3 PROPELLANT

| | | | | | | | | | | |
|---|---|---|---|---|---|---|---|---|---|---|
| | | | | | | | | | | throughout |
| BC-166-53 | 3780 | 2468 | 3038 | | | 90 | | | | Heavy porosity throughout |
| BC-166-54 | 4655 | 4517 | 4586 | 93 | 90 | 91 | | | | |
| BC-166-55 | 6485 | 6368 | 6413 | 95 | 92 | 93 | 0.608 | 0.887 | 1.171 | Low density |
| BC-166-56 | 12981 | 11665 | 12142 | 96 | 93 | 94 | 0.710 | 1.419 | 1.585 | Scattered low density areas |
| BC-166-57 | 6443 | 4924 | 5584 | 94 | 90 | 92 | 0.693 | 1.613 | 1.036 | Heavy porosity throughout |
| BC-166-59 | 7017 | 6429 | 6688 | 94 | 86 | 92 | | | | |
| BC-166-61 | | | | 80 | 60 | 70 | | | | Lacks consolidation |
| BC-166-62 | | | | 94 | 92 | 93 | | | | Lacks consolidation |
| BC-166-64 | 10500 | 7084 | 8450 | 91 | 86 | 88 | 0.696 | 1/020 | 1.350 | Numerous hairline cracks throughout |
| BC-166-65 | 5806 | 4790 | 5272 | 94 | 88 | 91 | 0.838 | 1.100 | 1.515 | Low density areas (lines) throughout |
| BC-166-68 | | | | 95 | 93 | 94 | | | | Lacks consolidation |
| BC-166-69 | 9360 | 6818 | 8029 | 94 | 90 | 92 | 0.669 | 0.980 | 1.137 | Low density areas |
| BC-166-72 | | | | 96 | 94 | 95 | | | | Consolidation voids throughout |

Several mixes contained consolidation voids or heavy porosity. Five grains were not sufficiently consolidated to allow physical testing. (See BC-166-49, -51, -61, and -72, Table VIII.)

As anticipated, the void-free example 3 propellant grains were characterized by relatively high tensile strength (134 psi average for five grains), low elongation (3.6 average), and high modulus (8061 psi average) as shown in Table VIII. No attempts were made to modify the polymer or crosslinker characteristics of the propellant binder system.

Burn rates for five void-free example 3 propellant grains were relatively high, with average values of 0.704./sec at 500 psi, 1.081 in./sec at 1000 psi, and 1.352 in./sec at 1500 psi, as shown in Table VIII.

Grain BC-166-69, intended as the example 3 optional mix, exhibited favorable mechanical and burn rate characteristics. Physical and ballistic properties of the cured propellant are recognized as less than optimum. The propellant could be optimized to account for a change in particle size and increased solids loading to provide more desirable physical and ballistic propellant characteristics. The processing characteristics of the example 3 formulation were realistic, however, as far as the high solids low shear process demonstration purposes of this invention are concerned.

Three control mixes (No. 3921-52, 3921-66, and BC-166-67) were made of example 1 propellant by conventional techniques using a Baker-Perkins mixer. The control mix No. 3921-52 was considered invalid due to a formulation irregularity. The propellant mixes were vacuum cast with vibration on a standard mold designed to aid physical and ballistic testing of the resultant grains. Control mixes of formulation example 3 containing UFAP were not processible by conventional methods.

Tensile properties were obtained using an Instron Tensile Tester, model TTC. A minimum of three tensile samples were tested for each propellant grain evaluated. Durometer values were measured with a Pandux Model 306, Type A durometer tester. Strand data were obtained with a strand burning unit manufactured by Atlantic Research Corp. A minimum of three strands were tested at each test pressure.

Three Example 1 propellant mixes (BC-166-66, -70, and -71) were made holding the low shear mix process parameters constant. Mixing was accomplished in two steps to permit high temperature mixing of the binder ingredients to ensure homogeneous mixing and complete cure. All three mixes utilized the 3/16 inch diameter extrusion die and were freeze-dried at −100° C. to remove diluent from the propellant pellets. A 2 hour vacuum dry cycle was used to ensure removal of possible moisture contamination from the pellets. The cast grains were consolidated at 55 psi and cured at 140° F. at 0 psi pressure for 7 days. All grains attained full cure, and were tested to determine mechanical properties and burn rate characteristics.

Properties of the grains produced by the low shear process were approximately equivalent to those of the control mixes made by conventional techniques. Tensile properties of the low shear mixed propellant were found to be slightly lower, and burn rates slightly higher than the control. (See mixes BC-166-66, -70, and -71, Table VI. The average specific gravity of the low shear mixes was equivalent to the control mixes, 1.735 versus 1.725, respectively. The average tensile strength of the low shear mixes was 51.3 psi compared to 59.8 psi for the control mixes, or 86 percent of the control.

Elongation characteristics of the low shear mixes averaged 59.8 percent. This was only slightly improved over the tensile properties and was 87 percent of the average value of the control. Modulus values of the low shear mixes were shown to be consistently lower than the control mixes. With approximately 5 percent variation between the three low shear mix modulus values, the average was only 60 percent of the average modulus of the control.

A comparison of the mechanical test results of the two Example 1 control mixes and the three mixes made by the low shear mixing process are shown in Table IX.

TABLE IX

MECHANICAL PROPERTIES OF EXAMPLE 1 PROPELLANT FORMULATION

| Mix Type | Specific Gravity | T.S. | Elongation | Modulus |
|---|---|---|---|---|
| Control | | | | |
| 3921-66 | 1.720 | 62.3 | 65.3 | 613 |
| BC-166-67 | 1.729 | 57.3 | 72.5 | 416 |
| Low Shear | | | | |
| BC-166-66 | 1.728 | 46.1 | 58.9 | 291 |
| BC-166-70 | 1.739 | 53.9 | 62.6 | 310 |
| BC-166-71 | 1.739 | 54.0 | 56.8 | 326 |
| Average Control | 1.725 | 59.8 | 68.9 | 515 |

TABLE IX-continued

MECHANICAL PROPERTIES OF EXAMPLE 1 PROPELLANT FORMULATION

| Mix Type | Specific Gravity | T.S. | Elongation | Modulus |
|---|---|---|---|---|
| Average Low Shear | 1.735 | 51.3 | 59.8 | 309 |
| Ratio of Average Values (Low Shear/Control) | 100.6% | 86% | 87% | 60% |

Burn rate characteristics of the three Example 1 propellant grains manufactured by the low shear process, based on ¼×3/16 inch strands, was slightly higher than anticipated. Burn rates averaged 1.68 in./sec at 500 psi, 0.241 in./sec at 1000, and 0.346 in./sec at 1500 psi. Burn rate slopes varied from 0.62 to 0.66. Average burn rates of the low shear mixed propellant was from approximately 5 to 11 percent higher than the average burn rates of the control propellant. Average values for pressure exponents were equivalent for low shear mixed propellant and control mixes. However, the control propellant exhibited a much wider variation in pressure exponent values (0.65±0.11) than the low shear mixed propellant (0.53±0.02). Strand data are listed in Table X.

TABLE X

STRAND RATE OF EXAMPLE 1 PROPELLANT FORMULATIONS

| Mix Type | rb 500 | rb 1000 | rb 1500 | n* |
|---|---|---|---|---|
| Control | | | | |
| 3921-66 | 0.150 | 0.256 | 0.346 | 0.76 |
| BC-166-67 | 0.152 | 0.203 | 0.280 | 0.54 |
| Low Shear | | | | |
| Bc-166-66 | 0.170 | 0.238 | 0.352 | 0.64 |
| BC-166-70 | 0.164 | 0.236 | 0.330 | 0.62 |
| BC-166-71 | 0.169 | 0.248 | 0.356 | 0.66 |
| Average Control | 0.151 | 0.230 | 0.313 | 0.65 |
| Average Low Shear | 0.168 | 0.241 | 0.346 | 0.64 |
| Percent Variation | +11 | +4.8 | +10.5 | −1.5 |

*Pressure exponent

Example 3 propellant containing 3.8 percent UFAP and 92 percent solids loading was the propellant selected as difficult to process by conventional methods. The propellant was found to be unprocessible by conventional means, thus no control was available for purposes of comparison with mixes made by the low shear mixing process. The high solids loaded KAA-102 (Mod 1) propellant was found to be readily processible by the low shear process.

Results of tests conducted to aid in the determination of optimum processing parameters indicated the possible need for a requirement for additional consolidation pressure exceeding the 110 psi maximum imposed by the first design during the initial propellant cure operation. Following a slight equipment modification, three grains were cast and consolidated at 150 psi in an effort to improve the consolidation characteristics of the propellant. The application of additional pressure did not improve the consolidation qualities of two of the grains. Apparently, the solids loading for the Example 3 propellant provided marginal dilatency characteristics since additional pressure was not effective in increasing pellet consolidation. The third grain appeared to be consolidated to a satisfactory degree. X-ray inspection indicated low density lines similar to the grains consolidated at 110 psi. Additional testing was desirable upon inspection of the test data but test results were received after termination of propellant manufacture phase of the program.

For purposes of comparison and reproducibility, BC-166-64 and BC-166-65, cured at 110 psi, will be discussed with grain BC-166-69, cured at 150 psi. BC-166-69 was consolidated at 150 psi and cured at 38 psi. BC-166-64 and -65 were consolidated at 110 psi and cured at 38 and 0 psi, respectively. Propellant cure of all three grains was performed at 140° F. for 7 days. Extrusion was performed using a 3/16 diameter extrusion die. Diluent removal was accomplished with the freeze-dry fixture at −100° F. for 22 hours. An additional two hours vacuum dry cycle at minimum vacuum was included after freeze-drying to eliminate possible moisture contamination.

Results of physical tests indicated that the Example 3 propellant is characterized by high tensile strength, low elongation, and high tensile modulus. Good correlation was shown with grains BC-166-64 and BC-166-65 as follows: Specific gravity, 1,820 reported for both grains; tensile strength, 115 psi versus 116.5 psi; elongation 3.45 percent versus 3.6 percent; and modulus of 8450 psi versus 5272 psi, respectively. Physical properties of BC-166-69 closely approximate those of grain BC-166-65 except for a higher tensile strength (145 psi), as shown in Table XI.

Burn rate characteristics of the Example 3 propellant grains were relatively high due to the high solids loading and inclusion of the UFAP in the formulation. Burn rates up to 0.669 in./sec at 500 psi, 0.980 in./sec at 1000 psi, 1.137 in./sec at 1500 psi, and a pressure exponent of 0.49 were recorded for grain BC-166-69 which was processed at near optimum conditions (Table XI). Burn rates and pressure exponent of grains, such as BC-166-56, processed at other than optimum conditions (e.g., 180° F. cure temperature) reached 1.419 in./sec at 1000 psi, 1.585 in./sec at 1500 psi, and a pressure exponent of 0.76. (See Table VIII)

Manufacture of the Example 3 formulation demonstrated the capability of the low shear mixing process for processing highly viscous, high solids loaded propellants. The basic propellant formulation of Example 2 was modified by increasing the solids loading and adding 0.6μ UFAP to increase processing difficulty. Physical or ballistic properties of the resultant cured propellant was considered secondary and was only documented for purposes of comparison with characteristics of other known propellant formulation.

TABLE XI

COMPARATIVE RESULTS OF EXAMPLE 3 PROPELLANT

| | Mix Number BC-166-64 | BC-166-65 | BC-166-69 |
|---|---|---|---|
| Console Pressure, psi | 110 | 110 | 150 |
| Cure Pressure, psi | 38 | 0 | 38 |
| Cure Temperature, °F. | 140 | 140 | 140 |
| Cure Time, days | 7 | 7 | 7 |
| Mechanical | | | |
| Specific Gravity | 1.820 | 1.820 | 1.816 |
| Tensile Strength, psi | 115 | 117 | 145 |
| Elongation, % | 3.5 | 3.6 | 3.5 |
| Modulus, psi | 8450 | 5272 | 8029 |
| Burn Rate, rb, in./sec | | | |
| 500, psi | 0.696 | 0.838 | 0.669 |
| 1000, psi | 1.020 | 1.100 | 0.980 |
| 1500, psi | 1.350 | 1.515 | 1.137 |

TABLE XI-continued

| COMPARATIVE RESULTS OF EXAMPLE 3 PROPELLANT | | | |
|---|---|---|---|
| | Mix Number | | |
| | BC-166-64 | BC-166-65 | BC-166-69 |
| Pressure Exponent, n | 0.60 | 0.52 | 0.49 |

In accordance with this invention, the low shear mixing process demonstrates a processing concept which eliminates the high shear mixing environment of state-of-the-art techniques. The process has been shown to be capable of manufacturing propellants which were known to be processible by conventional means and also to manufacture high viscosity, high solids loaded propellants not processible by conventional methods. Since mold filling was accomplished by transfer of small uniform frozen propellant granules, the normal high shear environment associated with final mixing or diluent removal via slip plate and casting associated with conventional methods are eliminated. High viscosity propellant flow per se was avoided in the low shear process. High viscosity flow was approached only during the propellant consolidation step, conducted at near the cure temperature of the propellant, which involved only deformation of the softened propellant granules to eliminate the void space between granules to form a non-porous grain and cause the propellant mass to conform to the mold contour.

While the invention has been described with particularity in reference to specific embodiment thereof, it is to be understood that the disclosure of the present invention is for the purpose of illustration only and it is not intended to limit the invention in any way, the scope of which is defined by the appended claims.

What is claimed is:

1. A low shear mixing process for preparing high solids, high viscosity solid rocket propellants consisting essentially of the steps of (a) blending the liquid and solid propellant ingredients with an inert diluent liquid selected from the group consisting of methylene chloride, heptane, 2—2 dimethyl butane, 1—1 dichloroethane and n-hexane; (b) freezing the blended mix and granulating the same to form propellant granules; (c) removing the diluent by freeze drying said granules under vacuum conditions; (d) loading said diluent-free granules into a mold under vacuum conditions to effect the consolidation and curing of said granules to produce a high solids loaded solid rocket propellant characterized by having a solids load in excess of 90 percent.

2. A process in accordance with claim 1 wherein said diluent is methylene chloride.

* * * * *